US011843167B2

(12) United States Patent
Pigoso Destro et al.

(10) Patent No.: US 11,843,167 B2
(45) Date of Patent: Dec. 12, 2023

(54) MICROSTRIP ELECTRICAL ANTENNA AND MANUFACTURING METHOD

(71) Applicant: Ibbx Inovacao em Sistemas de Software e Hardware Ltda, Capivari (BR)

(72) Inventors: Luis Fernando Pigoso Destro, Mombuca (BR); William Norberto Aloise, Sao Paulo (BR); Vanderlei Goncalves, Capivari (BR)

(73) Assignee: IBBX Inovacao em Sistemas de Software e Hardware Ltda, Capivari (BR)

( * ) Notice: Subject to any disclaimer, the term of this patent is extended or adjusted under 35 U.S.C. 154(b) by 18 days.

(21) Appl. No.: 17/374,520

(22) Filed: Jul. 13, 2021

(65) Prior Publication Data

US 2023/0014041 A1 Jan. 19, 2023

(51) Int. Cl.
*H01Q 9/42* (2006.01)
*H01Q 1/38* (2006.01)

(52) U.S. Cl.
CPC ..... *H01Q 1/38* (2013.01); *H01Q 9/42* (2013.01)

(58) Field of Classification Search
CPC ..... H01Q 1/38; H01Q 9/42; H01Q 1/243; H01Q 1/36; H01Q 19/13
See application file for complete search history.

(56) References Cited

U.S. PATENT DOCUMENTS 5,363,114 A * 11/1994 Shoemaker ..... H01Q 1/38 343/906
2002/0075186 A1* 6/2002 Hamada ..... H01Q 1/36 343/702
2004/0075608 A1* 4/2004 Scott ..... H01Q 1/243 343/729
2004/0196190 A1* 10/2004 Mendolia ..... H01Q 9/0407 343/846
2005/0110692 A1* 5/2005 Andersson ..... H01Q 19/005 343/702
2008/0316111 A1* 12/2008 Aoyama ..... H01Q 1/38 343/700 MS
2009/0002243 A1* 1/2009 Dahlstrom ..... H01Q 21/30 343/702
2009/0015480 A1 1/2009 Shafer et al.
2014/0320367 A1* 10/2014 Alkhateeb ..... H01Q 1/38 343/804
2016/0072188 A1* 3/2016 Alkhateeb ..... H01Q 9/145 343/823
2020/0195059 A1 6/2020 De Sousa et al.
(Continued)

OTHER PUBLICATIONS

Yuan Yao, Design of a Multipolarized RFID Reader Antenna for UHF Near-Field Applications, IEEE Transactions on Antennas and Propagation, vol. 65, No. 7, Jul. 2017, pp. 3344-3351.
(Continued)

*Primary Examiner* — David E Lotter
(74) *Attorney, Agent, or Firm* — Lippes Mathias LLP

(57) ABSTRACT

A microstrip electrical antenna (1) and its respective method of manufacturing, wherein the antenna (1) is of the electrically small kind being configured based on at least one wave parameter with which it will be operated. The present disclosure also refers to an equipment endowed with the electrical antenna (1).

24 Claims, 7 Drawing Sheets

(56) References Cited

U.S. PATENT DOCUMENTS

Figure 1:
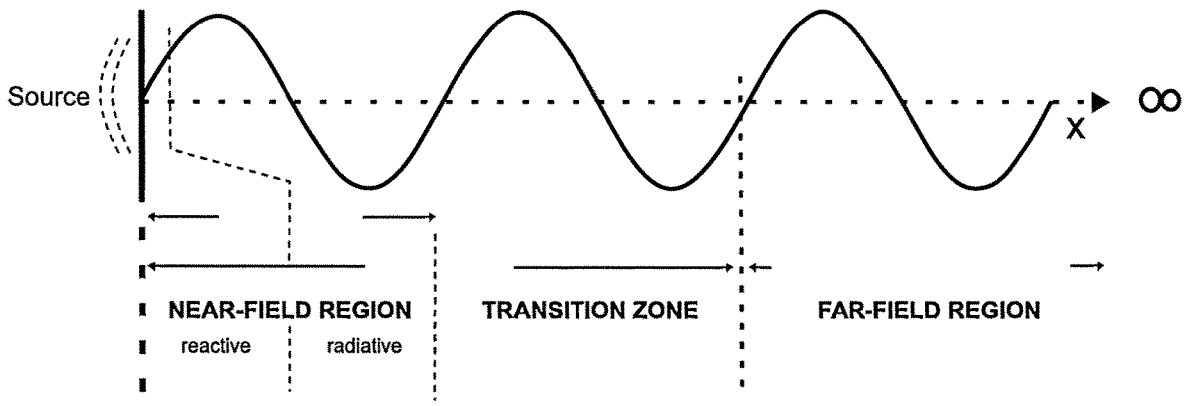

2021/0111494 A1* 4/2021 Haridim ..... H01Q 5/15

OTHER PUBLICATIONS

Xiuping Li, A Novel Near-Field UHF RFID Reader Array Antenna for Configurable Electrically Large Reading Area, IEEE Transactions on Antennas and Propagation, vol. 67, No. 11, Nov. 2019, pp. 6714-6723.
Written Opinion of the International Searching Authority issued for PCT Application No. PCT/BR2022/050257, dated Nov. 28, 2022.
International Search Report issued for PCT Application No. PCT/BR2022/050257, dated Nov. 28, 2022.

* cited by examiner

MICROSTRIP ELECTRICAL ANTENNA AND MANUFACTURING METHOD

The present invention refers to a microstrip electrical antenna and its respective method of manufacturing, wherein said antenna is an electrically small one being dimensioned based on at least one wave parameter with which it will be operated. The present invention also refers to an equipment endowed with said electrical antenna.

DESCRIPTION OF THE STATE OF THE ART

In a general context, there is a known tendency that devices are made increasingly smaller. With this, the space available for the electronic components in them also decreases, including those related to wireless technologies such as antennas, which entails a series of challenges to develop these devices.

Specifically in relation to said antennas, there are various known studies on the use thereof in different applications, chiefly in the near field, to which the present invention refers.

"Near field" is a region of space/time considered in the transmission of electro-magnetic waves. It refers to a finite interval given based on the distance between the transmitter, called point zero, and the "far-field". This interval has three subintervals, namely: reactive near-field, radiative near-field and transition zone. All these intervals depend directly on a wavelength and the physical size of the transmitter antenna. As can be seen in the equations below, which relate near-field with wavelength, in order to be in fact in the near-field at distances considered regular for the use of the invention applied to electronic devices, it is important to operate at low frequencies.

$$PL(f, d) = \frac{G_{TX}G_{RX}}{4}\frac{1}{(kd)^2}$$

$$PL_E(d, f) = \frac{G_{TX}G_{RX(E)}}{4}\left(\frac{1}{(kd)^2} - \frac{1}{(kd)^4} + \frac{1}{(kd)^6}\right)$$

$$PL_H(d, f) = \frac{G_{TX}G_{RX}}{4}\left(\frac{1}{(kr)^2} + \frac{1}{(kr)^4}\right)$$

$$k = 2\pi/\lambda$$

The solutions that operate at "low frequency" and near field applied to a purpose of transmitting wireless power for small devices have anomalous behaviors of magnitudes and electro-magnetic phenomena poorly understood to date, which have been studied in-depth in recent research throughout the development of this solution.

Below are some of these undesirable and recurrent phenomena in the state of the art:

- Low gain (G) regardless of the physical size of the antennas;
- Change of wave impedances waves in the free space based on Tx/Rx distance, both in a Real part (R) and in an imaginary part (Jx);
- Gap between fields E and H based on the Tx/Rx distance;
- An amount of power is not distributed equally between fields E and H;
- Components of field E (E theta, E phi and Er) and H (H theta, H phi and Hr) have different intensity than in known far-field and
- Low radiation resistance in antennas.

Additionally, it is worth noting that in these specific cases conventional mathematical tools do not apply properly.

So the state of the art offers no solution that operates in "low frequency" and near-field and that presents suitable applications and respective benefits for transmitting wireless power to apparatuses, especially those of the "small devices" type.

Therefore, the solutions known in the state of the art do not enable the utilization of the benefits of applications in low frequency and near field in small devices, since these were not designed and built in an unconventional manner especially for these applications. This is because special antennas and circuits are necessary for this purpose and not known in the state of the art to date.

OBJECTIVES OF THE INVENTION

An objective of the present invention is to provide an electrical antenna solution, method of manufacturing thereof and apparatus endowed with said antenna that advantageously operates in low frequency and near field.

An objective of the present invention is to provide an electrical antenna solution, its method of manufacturing and apparatus endowed with said antenna that advantageously presents relative to far-field:

- Greater amount of power available for a receiver;
- More linear power density based on the distance;
- Availability of energy distributed evenly at 360° in the phi transmission plane; and
- Lower wave attenuation when crossing barriers.

An objective of the present invention is to provide an electrical antenna made especially based on the wave parameters in which it can operate.

An objective of the present invention is to provide an electrical antenna capable of acting to capture power from an external medium in a wireless manner and subsequent transmission of the power captured.

An objective of the present invention is to provide a method of manufacturing an electrical antenna made especially based on the wave parameters in which it can operate.

An objective of the present invention is to provide an equipment endowed with at least one electrical antenna made especially based on the wave parameters in which it can operate.

BRIEF DESCRIPTION OF THE INVENTION

The objectives of the present invention are achieved by means of an electrical antenna made based on a wavelength (λ) of a signal to be received or transmitted.

The objectives of the present invention are achieved by means of a method of manufacturing an electrical antenna made based on a wavelength (λ) of a signal to be received or transmitted.

The objectives of the present invention are achieved by means of an electrical equipment endowed with at least one electrical antenna made based on a wavelength (λ) of a signal to be received or transmitted.

SUMMARY DESCRIPTION OF THE DRAWINGS

Figure 2:
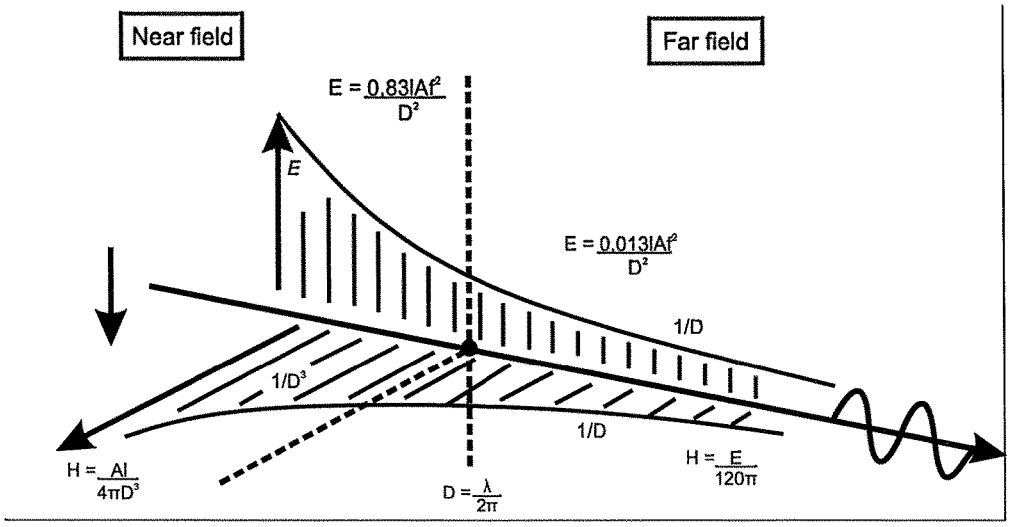
Figure 3:
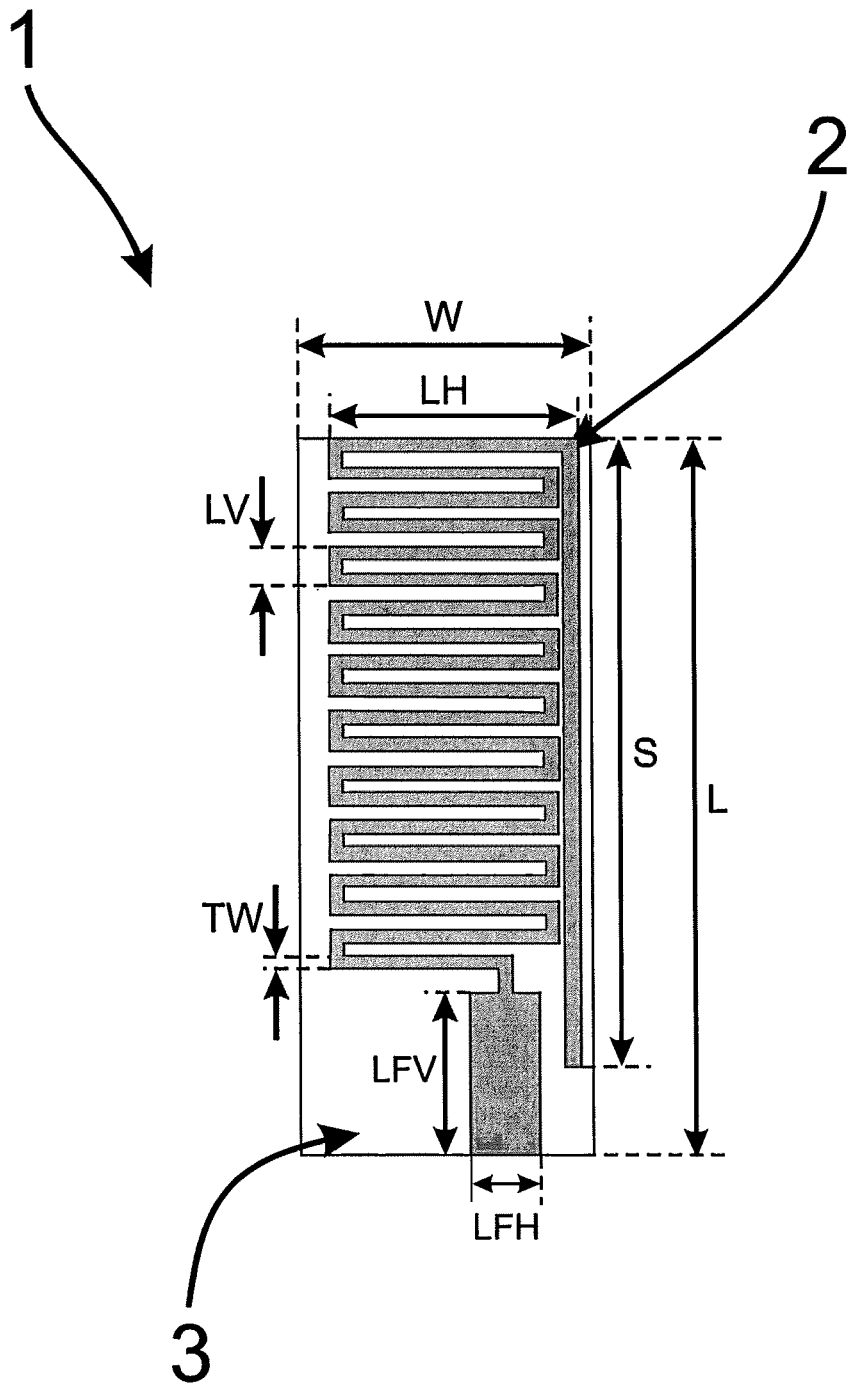
Figure 4:
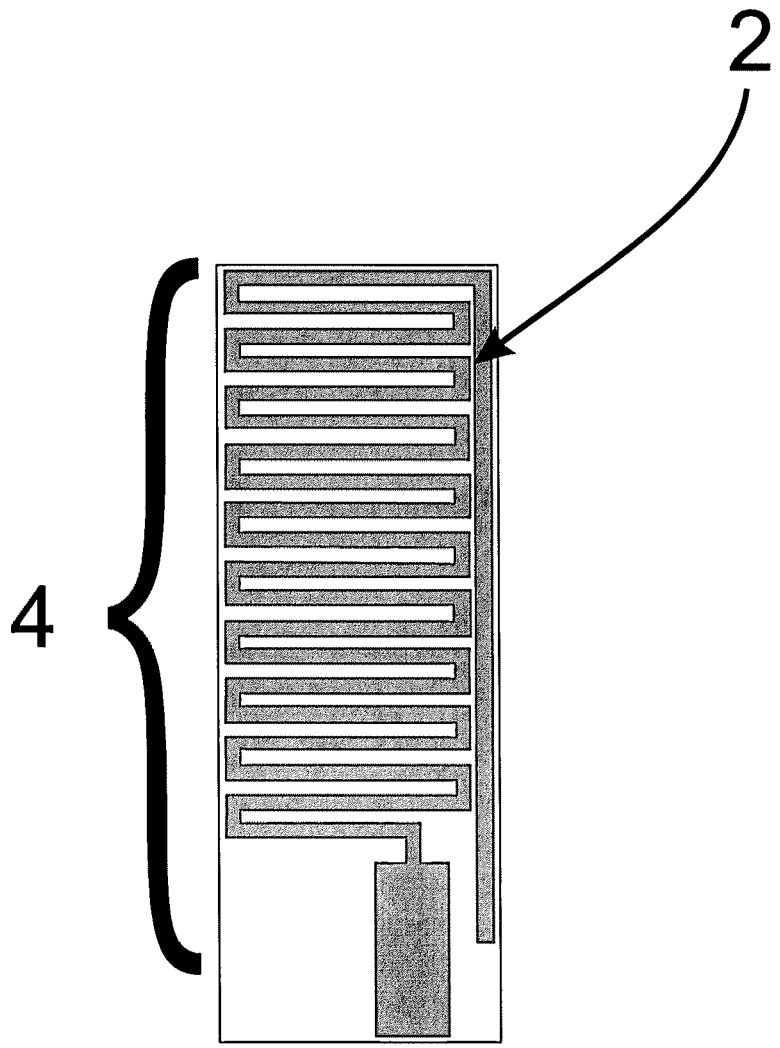
Figure 5:
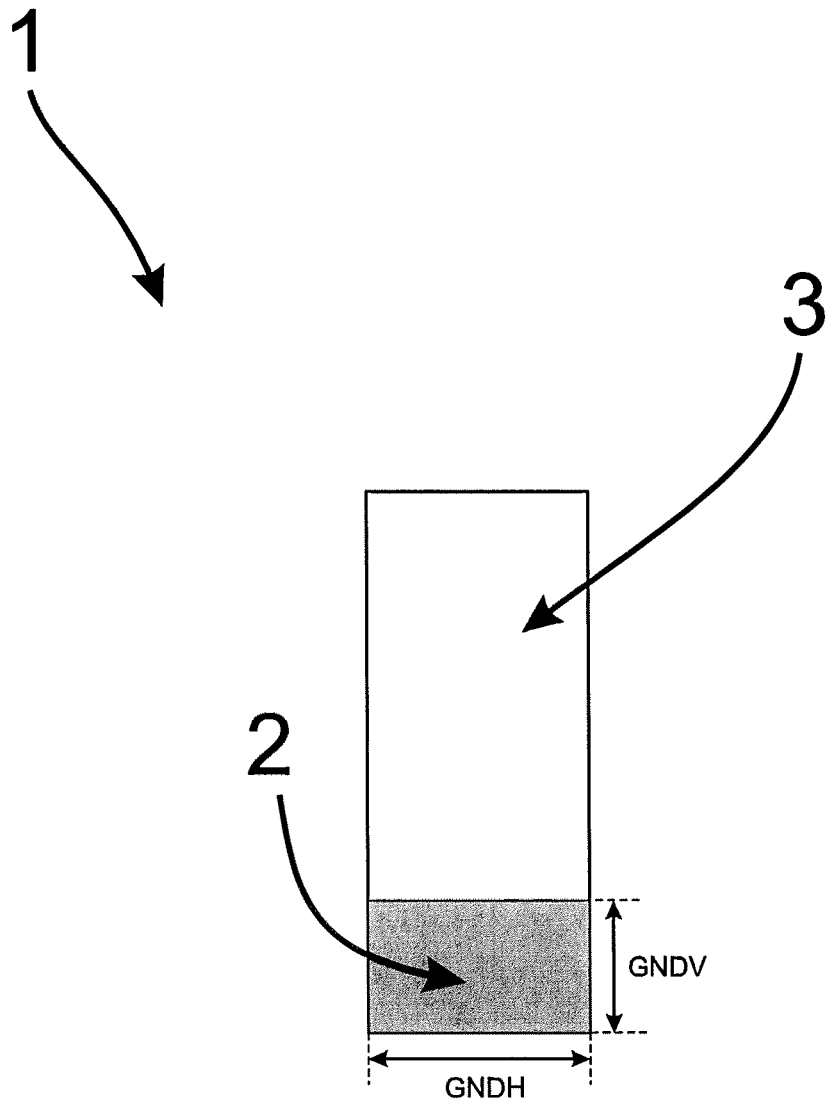
Figure 6:
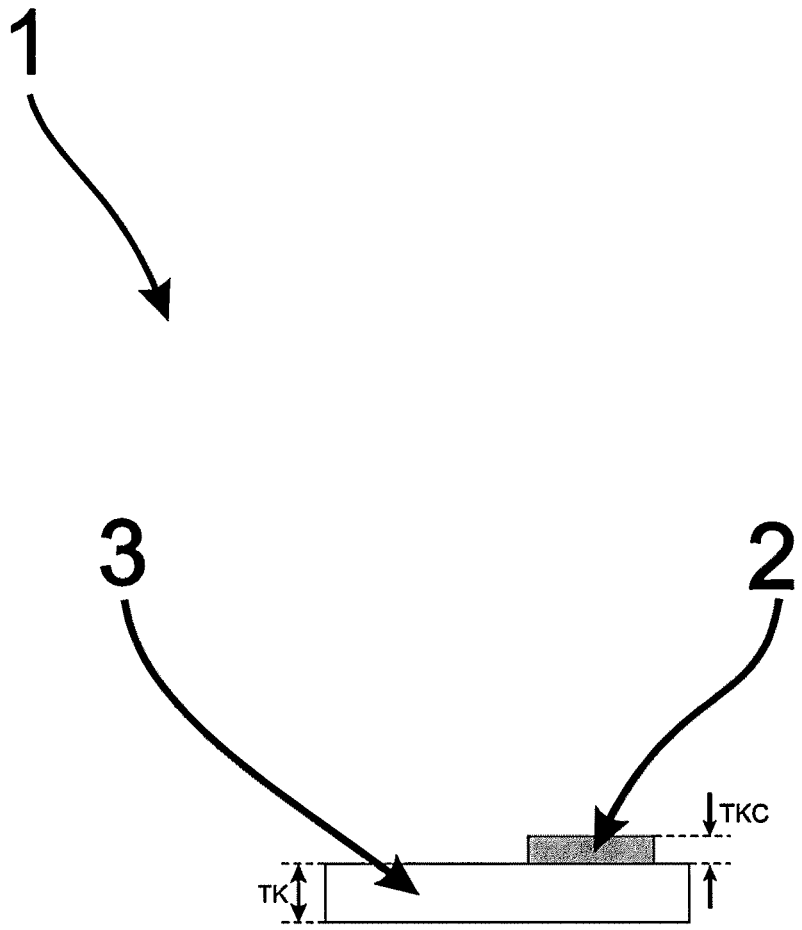
Figure 7:
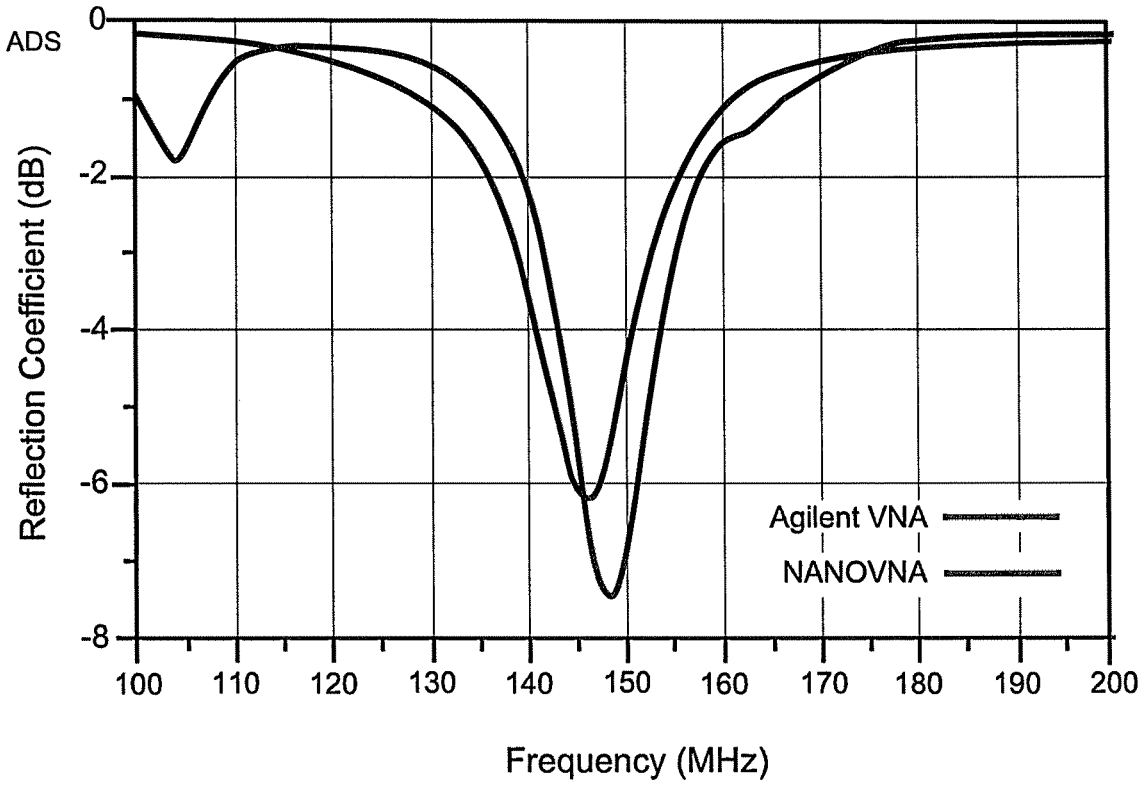
Figure 8:
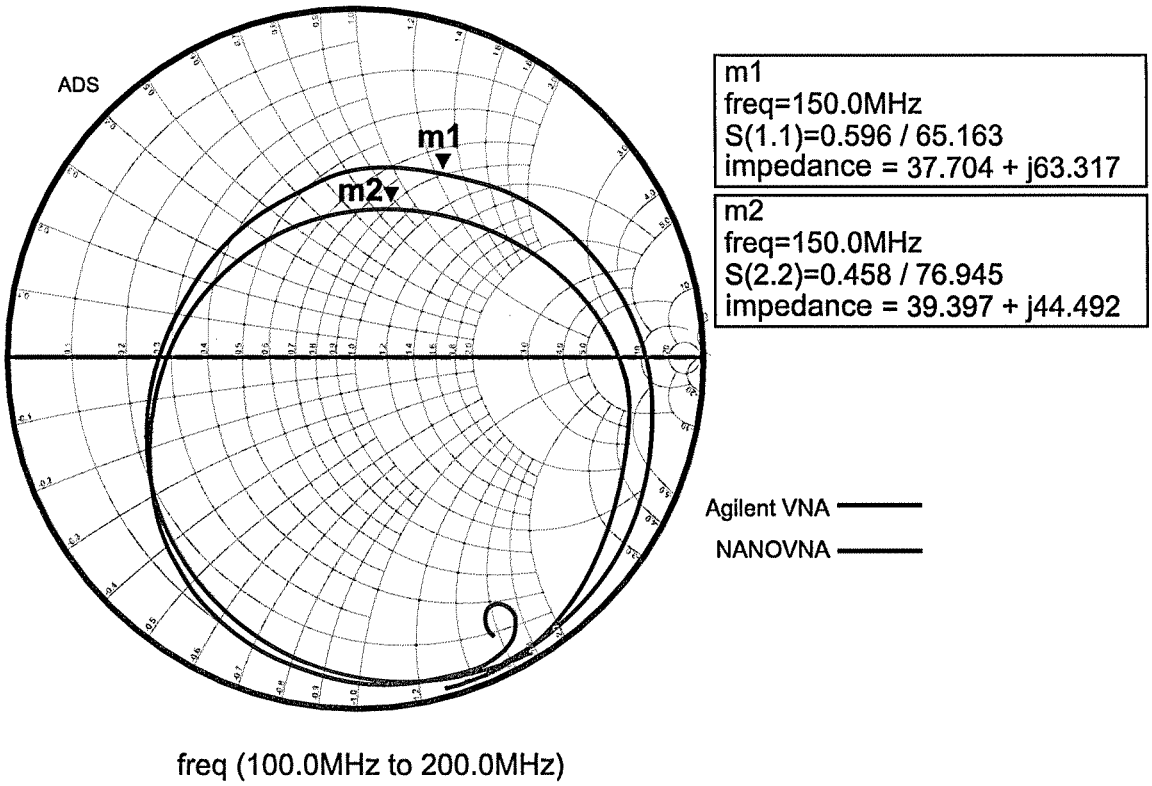

The present invention will now be described in greater detail, based on a sample embodiment represented in the drawings. The figures show:

FIG. 1—is an example of a wave, highlighting the near-field region, transition zone and far-field region;

FIG. 2—is an example of a wave, highlighting planes E and H and also the near-field and far-field regions;

FIG. 3—is a front view of the electrical antenna according to the teachings of the present invention;

FIG. 4—is a front view of the electrical antenna according to the teachings of the present invention, highlighting its tracks made of conductive material;

FIG. 5—is a rear view of the electrical antenna according to the teachings of the present invention;

FIG. 6—is a section view of the electrical antenna according to the teachings of the present invention;

FIG. 7—is a graph of reflection coefficients based on the frequency of the antenna according to the teachings of the present invention;

FIG. 8—is a Smith chart for the antenna according to the teachings of the present invention.

DETAILED DESCRIPTION OF THE DRAWINGS

Firstly, the present invention refers to an electrical antenna 1, now simply referred to as antenna 1 which is, in an arrangement, a microstrip "meander line" antenna 1. This geometry is altogether advantageous for the present invention since the tracks do not allow the existence of inductive reactance. More specifically, each section of the track 4 which is conductive and the substrate surrounding it forms capacitors (horizontal tracks) and inductors (vertical tracks). Therefore, the formation of these components allows the capacitances and inductances of each one to come into balance and advantageously to cancel themselves.

In an arrangement, this antenna 1 is of the Electrically Small Antenna (ESA) kind in relation to a wavelength, which has dimensions smaller than 0.1 wavelengths (0.1λ) in relation to a wave on which they can operate.

Specifically in this ESA arrangement, it is noted that some radiation characteristics may change, such as gain, effective length, effective area, impedances, among others.

So to use an ESA antenna it is necessary to understand these effects and look for other possible attributes, in order to accentuate them in the system seeking the best performance of the antenna 1 in capturing power.

In this context, the proposed electrical antenna 1 is arranged according to the teachings of the present invention to present specific properties (features) especially in relation to its geometry, magnetic permeability, permittivity, qualification and quantification of the materials that compose it.

The understanding and application of these properties have allowed the construction of high-performance electrical antennas 1 according to the teachings of the present invention, reaching relatively high performance in relation to the prior art.

These properties are directly linked to a deep knowledge of capacitive and inductive reactances present in antennas, which are often referred to as "parasite" elements, as they are unwanted and not considered in a precalculated RLC circuit.

However, this antenna 1 object of the present invention takes into account these elements and utilizes them as an ideal form of association for the near-field that also has reactive elements. Therefore, one may control these parameters in the antennas, cancelling wave reactances in the near-field through the controlled reactances of antennas 1, as better expounded below.

In any case and as can be seen in FIGS. 3, 4, 5 and 6, the electrical antenna 1 is basically composed of a track 4 made of conductive material 2 and an insulating substrate 3, being especially arranged for applications in low frequency and near field. A mere low frequency example with which the present invention as will described may perform well is between 100 kHz and 200 MHz, more specifically between 1 MHz and 150 MHz.

In practice, certainly other frequency ranges are also feasible and may be considered, but in real situations aiming especially to electrically charge electronic devices remotely, the application of the present invention might not be useful. This is because the distance between the antenna 1 and the power supplier (waves) varies depending on said frequency, such that very large distances, though feasible, would result in the loss of practical use of the proposed invention. In this context, the proposed characteristics will be better described below.

Geometry

As to the present invention, which concerns an electrically small antenna 1 which works at low frequencies and near field, a possible arrangement is "meander line" geometry, which features a track in "curves" and therefore an expanded and optimized surface.

This specific arrangement presents better magnetic field capture through magnetic flux with an insertion angle other than 90° compared to a normal line from the surface of the antenna 1 itself.

This geometry also allows that for each "curve" of the track 4 there is at least one dominant series inductance and for each parallel section there is at least one dominant series capacitance.

Therefore, each curve and each parallel line between the turns of the track 4 made of conductive material 2 of the antenna 1 must be calculated. With this, it is possible to obtain cancellations between inductances and capacitances of the antenna (i.e., a capacitance can cancel a specific impedance and vice versa), such that there is an equivalent and known RLC circuit in the antenna itself based on specific frequencies or frequencies that are work-desirable for the electric antenna 1.

More specifically, considering a certain frequency, the wave with which the antenna 1 is operating presents a certain impedance with a real part (radiation resistance) and an imaginary part (capacitive and inductive reactances). Physically speaking in relation to capacitive and inductive reactances, these represent the part of the wave in the form of "storage" between a capacitor and an inductor. Cancellation between these capacitances and inductances occurs when a resonance frequency (tuning or direct resonance) is reached for that specific wave frequency. When said cancellation occurs, the power previously stored in inductive (magnetic field) or capacitive (electric field) form becomes power in the circuit and can be used usefully therein.

When the antenna 1 is in operation, it is possible that unwanted and sometimes unpredictable parasitic elements may appear in the circuit. For example, the components of the antenna 1 such as the turns themselves (curves; stretches) of the track 4 may form a capacitor with a cellphone housing, with the hands of a user, with furniture on which the electrical equipment is put on and other components (e.g., external) that are predominantly electrical insulators. Such a parasitic element can hardly be calculated and considered in a project with satisfactory accuracy. Therefore, considering the frequency of operation of antenna 1, the present invention advantageously provides that the antenna 1 itself changes its capacitive or inductive components to perform the cancellation described above.

As certain impedances and capacitances that may be controlled by other components are variable, it is interesting that antenna 1 has a rather wide band, so that it is possible to have work space to change impedance or capacitance without frequency displacement.

As the antenna 1 is advantageously dedicated to capture as much power as possible, i.e. it is necessary to induce voltage at the ends of the antenna through E and H fields, then it may be considered a hybrid antenna 1, as it captures signals through two fields of a wave and not only through one as is the most common way.

Magnetic Permeability

In relation to the solutions known in the state of the art, it is noted that magnetic permeability is hardly taken into account in building antennas, because what is considered to be important for data transfer is the capture of electrical signals, the field E. Accordingly, the state of the art shows that it is more convenient to focus on the physical length of the antenna 1.

On the other hand, the present antenna 1 is capable of capturing as much power as possible in order to supply various devices and, to this end, it is also of great value to capture a magnetic field B, as there is a considerable amount of power in it sometimes even greater than in the electric field E.

Accordingly, much consideration should be given to the magnetic permeability of the antennas, and this directly impacts the geometry of said antenna 1, since the magnetic flux depends on an area of surface A of the antenna 1.

For this, the magnetic permeability of the antenna 1 (especially of the track 4 and of the substrate 3) is considered such that the higher the magnetic permeability of antenna 1, the more B field will be captured. This is because a high magnetic permeability allows a greater capture of electrons, even in materials considered insulating, such as the substrate 3 of the antenna 1.

However, in line with the teachings of the present invention, there is an "optimal" point of permeability according to the electromotive force equation based on the magnetic flow.

Electrical Permittivity of the Insulators and Substrates

The electrical permittivity may be understood as a magnitude that represents how much an electron reacts when a magnetic or electrical field is induced into it. So, the higher the permittivity, the more conductive a material is.

Permittivity is important in the antenna substrate 3, especially either in the device's own enclosure, or on the FR4 print plate, phenolite, etc.

The knowledge and mastery of this magnitude applied to the construction of antennas 1 object of the present invention is a contributing factor for reducing the physical length of these radiative elements without shifting a resonance frequency.

However, this application can lead to power losses, such that a mathematical model shows the ideal point in the permittivity value. With this one may choose the correct substrate 3 to be used and run applications on antennas 1 in various materials such as injected ones, for example.

In relation especially to the substrate 3, a lower permittivity is advantageous because it inhibits the presence of parasitic elements in the circuit.

Further, a greater permittivity is also advantageous because it allows shifting the resonance frequency downward (decreasing said frequency). That is, an antenna 1 can resonate at lower frequencies by the simple presence of a substrate that has relatively high permittivity without the need to change its dimensions.

In contrast, there are power losses in the circuit as a result of the substrate 3 material.

It is noted therefore that the resonance frequency of a given antenna 1 and its dimensions can both be changed based on such substrate 3. But in this context, it is important to consider the substrate 3 material mainly in relation to the points listed above.

Qualification and Quantification of the Materials

In an arrangement, the component materials of the electrical antenna 1 object of the present invention are copper and zinc, copper being in a positive line of the circuit and zinc in a negative line.

In particular, copper in the positive part and zinc in the negative part comes about because between these two materials there is a natural potential difference (voltage), a fact that increases the performance of power delivery by the electrical circuit of the antenna 1.

However, it is worth noting that other materials of suitable physicochemical properties could also be used according to each application, such as aluminum or silver for the track 4 (conductor) and FR4, phenolite, PVC or ABS for the substrate 3 (insulator), among others.

Arrangement

Aligned with the teachings of the present invention described above, the proposed electrical antenna 1 is made based on a wave length (λ) of a signal to be received or transmitted, wherein at least one parameter from among the following group can be arranged based on the wave length (λ): antenna length W, antenna height L, track length LH, track turn height LV, track height S, track thickness TW, track base height LFV, track base length LFH, grounding height GNDV, grounding length GNDH, antenna thickness TK and track thickness TKC.

The arrangement of the antenna 1 can also be based on other wave parameters such as, for example, its propagation speed or even the wave qualification parameters already previously cited (impedance, power in the form of inductive or capacitative reactances, real resistance, magnetic and electrical field and its non-perpendicularity, time, among others).

In any arrangement, however, the antenna 1 should be arranged to have impedances with variable real and imaginary parts (reactive), adjustable with the wave impedance based on the distances between transmitter and receiver.

This variable impedance is fundamental for achieving the objectives of the present invention, such that the antenna 1 can be associated with waves in the free space in a near-field and which, in turn, has impedances varying according to the distance between transmitter and receiver.

In addition to contributing this attribute, the electric antenna 1 optimizes the capture of two fields of a wave (the electric E and the magnetic B), thus using most of the power contained in an electromagnetic wave.

Obtaining Function Parameters of a Wavelength (λ)

For better clarifying how such parameters are obtained in a practical situation, an electrically small antenna manufacturing process in near field, such as the proposed invention, will be briefly described below.

A first step is to identify power densities present at points in the chosen range at which the antenna will be used (e.g., 1 m, 2 m and 3 m).

In other words, this step includes verifying what are the power densities for each antenna actuation point, at certain distance between transmitter and receiver. This step can be performed by means of specific mathematical methods, especially depending on the power density in near field at the chosen point, measured electric field and the impedance of the receiving antenna.

Another step includes calculating an effective area of said antenna 1, for instance based on a measured received power and the previously calculated near field power density.

Knowing the effective area for each point, it is now possible to adjust the impedance of the antenna 1 so as to better match a wave impedance in the near field. Thus, each time the antenna is adjusted, it is possible to verify what happened to its effective area.

At this point, it was noted that certain dimensions are advantageously consolidated, because they bring optimal results of effective area, that is, efficiency of the electrically small antenna in near field aligned with the teachings of the present invention. These dimensions will be exemplified below.

Example 1

To better exemplify the parameters that can be arranged according to the wavelength (λ) aligned with the previous teachings, a proposed arrangement is exemplified below, in which the dimensions of the electrical antenna 1 are defined according to said wavelength (λ):

Antenna length W: from 0.0025λ to 0.025λ
Antenna Height L: from 0.0075λ to 0.075λ
Track length LH: from 0.002λ to 0.02λ
Track turn height LV: from 0.0003λ to 0.003λ
Track height S: from 0.005λ to 0.05λ
Track thickness TW: from 0.0001λ to 0.001λ
Track base height LFV: from 0.0025λ to 0.025λ
Track base length LFH: from 0.005λ to 0.05λ
Grounding height GNDV: from 0.0025λ to 0.025λ
Grounding length GNDH: from 0.0025λ to 0.025λ
Antenna thickness TK: from 0.00001λ to 0.0025λ
Track thickness TKC: from 0.0000001λ to 0.001λ.

Functioning And Operation

The electrical antenna 1 of the present invention can properly work as a wave transmitter or receiver. In both cases its operation is similar and will be described based on an operation in which it is desirable to supply electrical power to an external device, in which a first antenna F1 (transmitter) transmits power through the air to a second antenna F2 (receiver).

The second antenna F2 of the receiver is specially constructed, and identical to the first antenna F1 of the transmitter, but to adapt it to smaller sizes, its dimensions can be reduced as needed, through the teachings of the present invention based on a wavelength (λ).

The second antenna F2 first captures the electromagnetic signal (E and H fields) present in the air transmitted by the transmitter's first antenna F1.

After the second antenna F2 captures the E and H fields, it sends a signal to a subsequent component (not shown), which in turn can analyze the impedance of this wave so as to match the impedance of antenna 1 with that of the wave through impedance changes in a tuner block (not shown).

Thus, in general, there is one arrangement in which after capturing this signal, the antenna F2 sends the voltages to other components so that these signals are properly treated and rectified to meet the apparatus power supply needs.

By means of the proposed antenna 1 of the present invention it is possible to obtain a high power efficiency compared to the solutions known in the state of the art. For example, one may observe from FIGS. 7 and 8 that exemplify practical tests at a frequency of 150 MHz that there is a low reflection coefficient (in the order of −8 dB), which represents that the proposed antenna 1 allows to have a high harness of the power provided to it.

As the antenna 1 may be coupled to a block that automatically adjusts impedance according to the frequency variation of the wave as discussed earlier, the present invention provides low reflection regardless of the wave's frequency captured by the antenna 1.

In addition, and as already mentioned, the antenna 1 is of the electrically small kind, which makes it possible to work at low frequencies according to the present teachings. On the contrary, to achieve the same objectives proposed for said antenna 1 with a conventional antenna known in the state of the art and at low frequencies (high wavelength), the antenna would have to have extravagant dimensions, which in practice would not allow its use in all types of electronic apparatuses, especially those widely used today such as cellphones, tablets, laptops and peripheral devices in general.

In accordance with the above description and as can be observed in FIGS. 1 to 8, on a lower part of a front face of the antenna 1, the track 4 is on the substrate (e.g. on or contained in it). Said track 4 starts on a base, with dimensions base height LFV and base length LFH. This base protrudes upwards towards the substrate 3 and may be understood as coplanar to it. Starting from this base, a projection of track 4 begins.

In a preferred arrangement, the antenna 1 has track 4 featuring horizontal and vertical sections. Generally speaking, this track 4 extends parallel to the substrate 3 and can be understood as coplanar to it. The horizontal sections of the track 4 extend in the track length LH along the antenna length W, parallel to each other. Each horizontal section of the track 4 has an end connected to a vertical section that forms the track turn height LV, which is parallel to the antenna height L. In a preferred arrangement, the track length LH and the track turn height LV are equidistant and perpendicular to each other, thus forming the preferred geometry referred to as meander line.

In an arrangement, each section of the track 4 has the same thickness TW, but alternatively different thicknesses may be implemented along the track 4.

The track height S is formed with a section of the track 4 which protrudes from the last horizontal section of the track 4 towards the base of the track 4 itself, for example from an upper portion of the front face of the substrate 3 perpendicular thereto.

On a back side of the substrate 3 there is a grounding (GND), of dimensions grounding height GNDV and grounding length GNDV. In an arrangement, such grounding is parallel to the substrate 3 and can be understood as coplanar thereto.

Accordingly to the above, the present invention also comprises a method of manufacturing a microstrip "meander line" antenna 1, which has been described previously.

Thus, except for adaptations, the characteristics of said antenna 1 also apply to the method which is also object of the present invention.

In relation to the method of manufacturing an electrical antenna 1, it comprises a step of providing a conductive material 2 (of the tracks 4). In an arrangement, said material may be copper and also silver or aluminum, used in the arrangement of the tracks 4 of the antenna 1 to be manufactured. Another step of the method comprises proving an insulating substrate 3.

In an arrangement, these materials can be FR4, phenolite, PVC or ABS in the antenna 1 to be manufactured.

Another step of the proposed method comprises disposing the conductive material 2 and the insulating substrate 3 together so as to compose said electrical antenna 1 based on a wavelength (λ) of a signal to be received or transmitted.

This step may utilize various industrial processes broadly known such as injection, molding, pressing and others, which will not be described herein but are incorporated hereto as possibilities for achieving the objectives of the present invention.

However, it is worth emphasizing that this step of disposing the materials should occur such that they are arranged based on at least one parameter of the wavelength (λ) from among the group formed by: antenna length W, antenna height L, track length LH, track turn height LV, track height S, track thickness TW, track base height LFV, track base length LFH, grounding height GNDV, grounding length GNDH, antenna thickness TK and track thickness TKC.

With this, it is possible to guarantee that the electrical antenna 1 obtained by this method may be arranged for applications in low frequency and near field, advantageously allowing the objectives of the present invention to be achieved.

As already mentioned, the characteristics of the antenna 1 obtained through the proposed method have already been described previously and will not be described again in the present text. This same understanding applies to the detailings, example and arrangements of the electrical antenna 1 which apply, mutatis mutandis, to said method.

Additionally, to achieve the objectives of the present invention, an electrical equipment is also provided, having at least one electrical antenna 1, such as the one already previously described and that can be obtained by the method also already described.

This electrical equipment (not shown) may contain a plurality of additional components such as an electrical power source, rectifiers, oscillators, filters, amplifiers, couplers, tuners, switches, electrical elevators and reducers, among others of various kinds such as, for example, electrical and/or mechanical.

Therefore, the present invention advantageously allows an electrical antenna 1 to be obtained, arranged to operate in low frequency and near field, allowing electrical power to be captured and transmitted to devices with the function, for example, of electrically charging them. Examples of said equipment (devices) include cellphones, smartphones, computers, sundry electronics, gadgets, peripherals, etc.

Having described an example of a preferred embodiment, it should be understood that the scope of the present invention encompasses other possible variations, being limited only by the content of the accompanying claims, potential equivalents being included therein.

The invention claimed is:

1. A microstrip electrical antenna (1) for near field applications, said antenna comprising parameters that are designed based on a wavelength (λ) of a signal to be received or transmitted, wherein the parameters comprise the following: antenna length (W), antenna height (L), track length (LH), track turn height (LV), track height (S), track thickness (TW), track base height (LFV), track base length (LFH), grounding height (GNDV), grounding length (GNDH), antenna thickness (TK) and track thickness (TKC), wherein the antenna (1) comprises all of the following parameters:

antenna length (W): from 0.0025λ to 0.025λ
antenna height (L): from 0.0075λ to 0.075λ
track length (LH): from 0.002λ to 0.02λ
track turn height (LV): from 0.0003λ to 0.003λ
track height (S): from 0.005λ to 0.05λ
track thickness (TW): from 0.0001λ to 0.001λ
track base height (LFV): from 0.0025λ to 0.025λ
track base length (LFH): from 0.005λ to 0.05λ
grounding height of the (GNDV): from 0.0025λ to 0.025λ
grounding length (GNDH): from 0.0025λ to 0.025λ
antenna thickness (TK): from 0.00001λ to 0.0025λ
track thickness (TKC): from 0.0000001λ to 0.001λ.

2. The microstrip electrical antenna (1) according to claim 1, wherein said antenna (1) comprises a meander line geometry type including curves and parallel sections arranged such that for each curve there is at least one dominant series inductance and for each parallel section there is at least one dominant series capacitance.

3. The microstrip electrical antenna (1) according to claim 2, wherein said electrical antenna (1) is arranged so as to permit the appearance of an RLC circuit in the electrical antenna (1) itself, said RLC circuit being arranged based on wave frequencies.

4. The microstrip electrical antenna (1) according to claim 3, wherein said antenna (1) is arranged to receive an induced voltage, wherein the voltage induction allows said electrical antenna (1) to capture at least one field of a wave, wherein these fields may be at least one from an electrical field and a magnetic field.

5. The microstrip electrical antenna (1) according to claim 4, wherein said antenna (1) is made so that it has optimized magnetic permeability, which can be calculated based on an area of said electrical antenna (1).

6. The microstrip electrical antenna (1) according to claim 5, wherein said antenna (1) is made considering parameters related to the electrical permittivity.

7. The microstrip electrical antenna (1) according to claim 6, wherein said antenna (1) may act as wave transmitter or receiver.

8. The microstrip electrical antenna (1) according to claim 7, wherein said antenna (1) comprises a conductive material (2) and an insulating substrate (3).

9. The microstrip electrical antenna (1) according to claim 8, wherein said antenna (1) is made so as to have impedances with variable real and imaginary parts, wherein said impedances may be related to at least one from among a radiation resistance, capacitative and inductive reactance.

10. The microstrip electrical antenna (1) according to claim 9, wherein the impedance may be of the reactive kind.

11. The microstrip electrical antenna (1) according to claim 1, wherein the antenna (1) is arranged to capture waves from the air, wherein said waves may be of the electromagnetic kind.

12. The microstrip electrical antenna (1) according to claim 11, wherein the antenna (1) is of the electrically small kind.

13. A method of manufacturing an electrical antenna (1) comprising the steps of:

providing a conductive material (2);

providing an insulating substrate (3);

disposing the conductive material (2) and the insulating substrate (3) together so as to compose said electrical antenna (1), wherein the electrical antenna (1) comprises parameters that are designed based on a wave length (λ) of a signal to be received or transmitted, wherein the parameters comprise the following: antenna length (W), antenna height (L), track length (LH), track turn height (LV), track height (S), track thickness (TW), track base height (LFV), track base length (LFH), grounding height (GNDV), grounding length (GNDH), antenna thickness (TK) and track thickness (TKC), wherein the antenna (1) comprises all of the following parameters:

antenna length (W): from 0.0025λ to 0.025λ antenna height (L): from 0.0075λ to 0.075λ track length (LH): from 0.002λ to 0.02λ track turn height (LV): from 0.0003λ to 0.003λ track height (S): from 0.005λ to 0.05λ track thickness (TW): from 0.0001λ to 0.001λ track base height (LFV): from 0.0025λ to 0.025λ track base length (LFH): from 0.005λ to 0.05λ grounding height of the (GNDV): from 0.0025λ to 0.025λ grounding length (GNDH): from 0.0025λ to 0.025λ antenna thickness (TK): from 0.00001λ to 0.0025λ track thickness (TKC): from 0.0000001λ to 0.001λ, wherein the manufactured electrical antenna (1) is arranged for applications in near field.

14. The method of manufacturing a microstrip electrical antenna (1) according to claim 13, wherein said geometry may be of the meander line kind and arranged such that for each curve there is at least one dominant series inductance and for each parallel section there is at least one dominant series capacitance.

15. The method of manufacturing a microstrip electrical antenna (1) according to claim 14, wherein the step of disposing the conductive material (2) and the insulating substrate (3) together so as to compose said electrical antenna (1) is performed such that said antenna (1) is arranged to allow the appearance of an RLC circuit in the electrical antenna (1) itself, said RLC circuit being arranged based on wave frequencies.

16. The method of manufacturing a microstrip electrical antenna (1) according to claim 15, wherein the step of disposing the conductive material (2) and the insulating substrate (3) together so as to compose said electrical antenna (1) is performed such that said electrical antenna (1) is arranged to receive an induced voltage, wherein the voltage induction allows the electrical antenna (1) to capture at least two fields of a wave, wherein these fields may be an electrical field and a magnetic field.

17. The method of manufacturing a microstrip electrical antenna (1) according to claim 16, wherein the step of disposing the conductive material (2) and the insulating substrate (3) together so as to compose said electrical antenna (1) is performed such that the electrical antenna (1) has optimized magnetic permeability, which can be calculated based on an area of said electrical antenna (1).

18. The method of manufacturing a microstrip electrical antenna (1) according to claim 17, wherein the step of disposing the conductive material (2) and the insulating substrate (3) together so as to compose said electrical antenna (1) is performed such that the electrical antenna (1) is made considering parameters related to an electrical permittivity.

19. The method of manufacturing a microstrip electrical antenna (1) according to claim 18, wherein the step of disposing the conductive material (2) and the insulating substrate (3) together so as to compose said electrical antenna (1) is performed such that the electrical antenna (1) can act as wave transmitter or receiver.

20. The method of manufacturing a microstrip electrical antenna (1) according to claim 19, wherein the step of disposing the conductive material (2) and the insulating substrate (3) together so as to compose said electrical antenna (1) is performed such that the electrical antenna (1) may have impedances with variable real and imaginary parts, wherein said impedances may be related to at least one from a radiation resistance, capacitive and inductive reactance.

21. The method of manufacturing a microstrip electrical antenna (1) according to claim 20, wherein the step of disposing the conductive material (2) and the insulating substrate (3) together so as to compose said electrical antenna (1) is performed such that the electrical antenna (1) may have an impedance of the reactive kind.

22. The method of manufacturing a microstrip electrical antenna (1) according to claim 21, further comprising a step of capturing waves from the air when said electrical antenna (1) is in use, wherein said waves may be of the electromagnetic kind.

23. Electrical equipment comprising at least one microstrip electrical antenna (1), said antenna comprising parameters that are designed based on a wavelength (λ) of a signal to be received or transmitted, wherein the parameters comprise the following: antenna length (W), antenna height (L), track length (LH), track turn height (LV), track height (S), track thickness (TW), track base height (LFV), track base length (LFH), grounding height (GNDV), grounding length (GNDH), antenna thickness (TK) and track thickness (TKC), wherein the antenna (1) comprises all of the following parameters:

antenna length (W): from 0.00251λ to 0.0251λ antenna height (L): from 0.00751λ to 0.0751λ track length (LH): from 0.0021λ to 0.021λ track turn height (LV): from 0.00031λ to 0.0031λ track height (S): from 0.0051λ to 0.051λ track thickness (TW): from 0.00011λ to 0.0011λ track base height (LFV): from 0.00251λ to 0.0251λ track base length (LFH): from 0.0051λ to 0.051λ grounding height of the (GNDV): from 0.00251λ to 0.0251λ grounding length (GNDH): from 0.00251λ to 0.0251λ antenna thickness (TK): from 0.000011λ to 0.00251λ track thickness (TKC): from 0.00000011λ to 0.0011.

24. The electrical equipment according to claim 23, wherein the at least one microstrip electrical antenna (1) comprises: a conductive material (2);

an insulating substrate (3); the conductive material (2) and the insulating substrate (3) disposed together so as to compose said electrical antenna (1).

* * * * *